US005642861A

United States Patent [19]

Ogi et al.

[11] Patent Number: 5,642,861

[45] Date of Patent: Jul. 1, 1997

[54] PLASTIC SPRAY NOZZLE WITH IMPROVED DISTRIBUTION

[75] Inventors: Jeffrey M. Ogi, Rancho Cucamonga; David S. Worcester, Mission Viejo, both of Calif.

[73] Assignee: Camsco Manufacturing Corp., Azusa, Calif.

[21] Appl. No.: 522,593

[22] Filed: Sep. 1, 1995

[51] Int. Cl.[6] ..... B05B 1/14

[52] U.S. Cl. ..... 239/568; 239/553; 239/DIG. 1

[58] Field of Search ..... 239/590, 590.5, 239/553, 553.5, 597, 568, DIG. 1

[56] References Cited

U.S. PATENT DOCUMENTS

| | | | |
|---|---|---|---|
| 3,029,030 | 4/1962 | Dey | 239/DIG. 1 X |
| 3,266,737 | 8/1966 | Nees | 239/568 X |
| 3,788,552 | 1/1974 | Roberts | 239/DIG. 1 |
| 4,189,099 | 2/1980 | Bruninga | 239/DIG. 1 X |
| 5,299,742 | 4/1994 | Han | 239/DIG. 1 X |
| 5,322,223 | 6/1994 | Hadar | 239/DIG. 1 X |

FOREIGN PATENT DOCUMENTS

| | | | |
|---|---|---|---|
| 1528046 | 4/1968 | France | 239/DIG. 1 |

*Primary Examiner*—Kevin Weldon

*Attorney, Agent, or Firm*—Kelly Bauersfeld Lowry & Kelley, LLP

[57] ABSTRACT

An improved sprinkler head for an irrigation system wherein the sprinkler heads are designed to include spray means for adequately watering both the area within two feet, the "dead zone", of each spray head and areas beyond two feet. The sprinkler head employs a high velocity primary outlet and a secondary low velocity spray outlet for covering the "dead zone". A tortuous pathway is formed between the primary passageway and second low velocity outlet which functions to induce turbulence substantially reducing pressure and velocity of the spray therefrom.

23 Claims, 7 Drawing Sheets

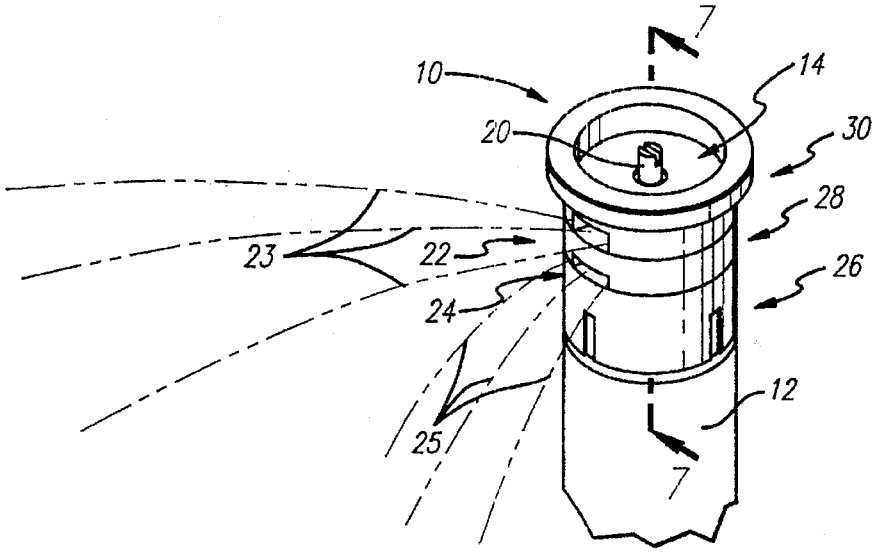
FIG. 1
FIG. 7
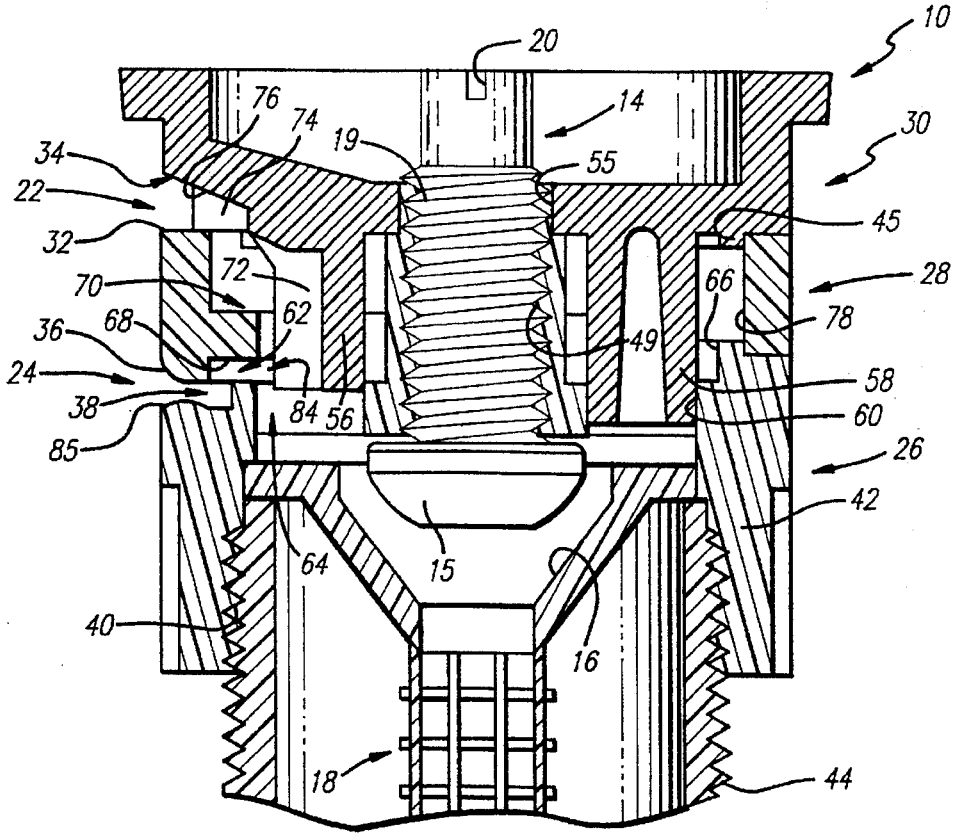

FIG. 2
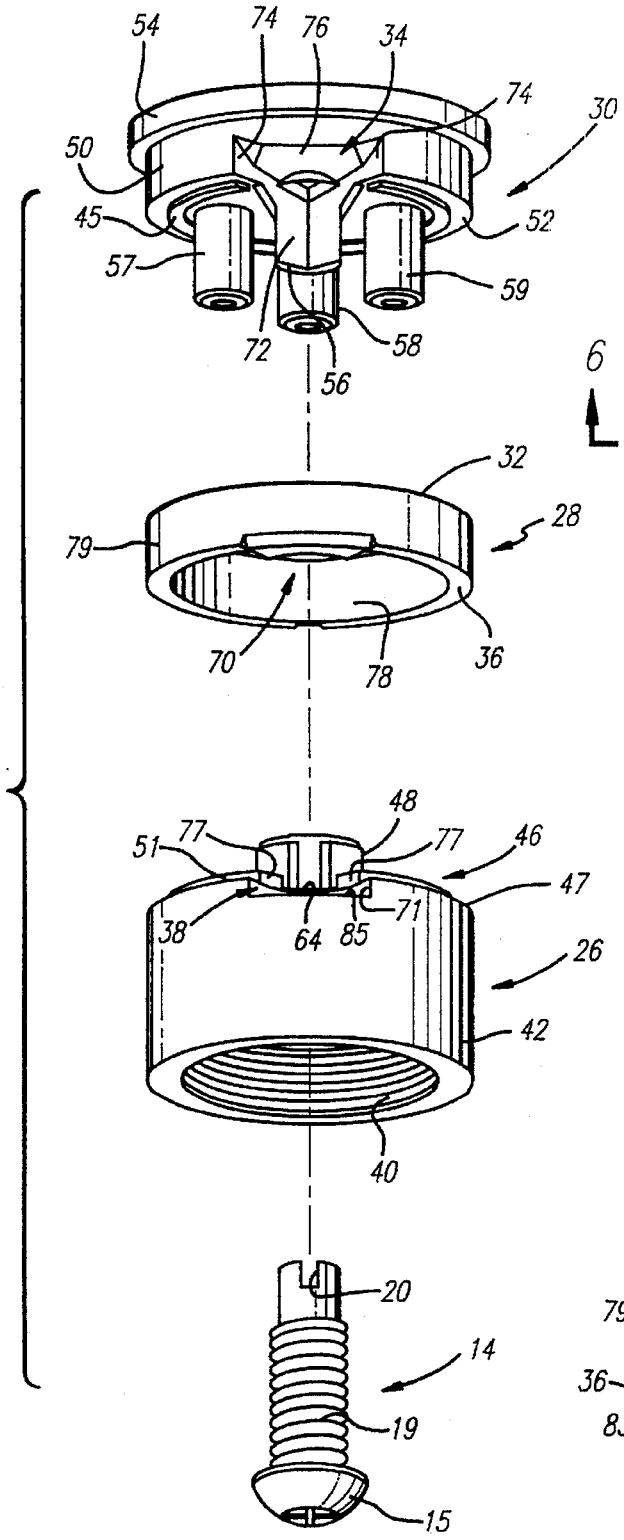
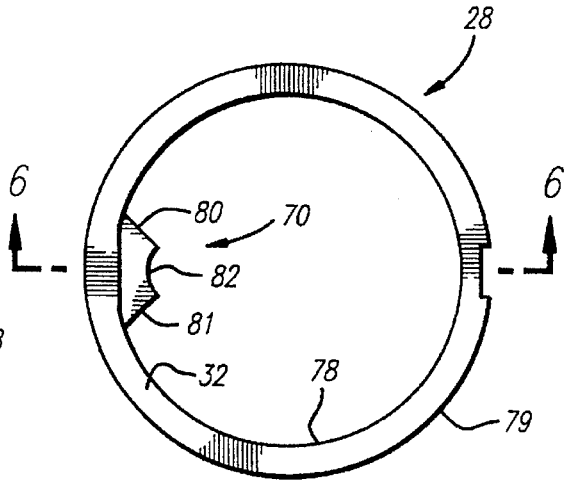
FIG. 5
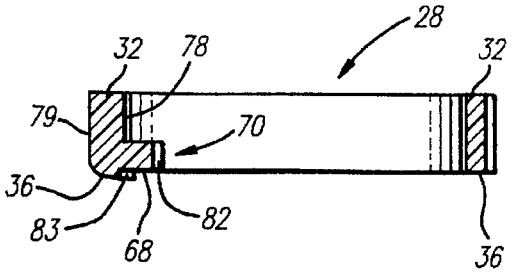
FIG. 6

PLASTIC SPRAY NOZZLE WITH IMPROVED DISTRIBUTION

FIELD OF THE INVENTION

This invention relates to spray head type irrigation sprinklers, and more particularly to a molded plastic spray head having substantially enhanced close-in water distribution.

BACKGROUND OF THE INVENTION

For many years, it has been recognized that the use of fixed or pop-up spray heads is the preferred type of irrigation system for use in situations where the available water supply pressure is relatively low or the area to be irrigated is relatively small and irregular in shape. One reason for this is that spray heads, which are relatively inexpensive to manufacture and maintain, and are available in a variety of full and part-circle configurations, operate on water supply pressures typically ranging between about 15 and 30 psi, and produce fan-shaped sprays which extend radially outwardly from the spray head over distances between about five and twenty feet, depending upon outlet nozzle size and water pressure. Further, in more recent years, spray heads have been developed to have matched precipitation rates so that the rate of water application produced by a given size full circle spray head is the same as that for the same size part circle spray head operating at the same supply pressure. That is, the spray heads are designed to discharge proportional gallonages of water that match the arc or part of a circle they cover so that, for example, a full circle spray head discharges twice the gallonage per unit time than that discharged by a half-circle spray head, and a quarter-circle spray head discharges half that of a half-circle spray head.

Matched precipitation rate spray heads are available in both metal, usually brass, and plastic, usually molded high strength material such as ABS plastic, and normally are coupled to the outlet of a stationary or pop-up tubular riser. Pressurized water admitted to the riser is projected outwardly by the spray head nozzle outlet as a pressurized fan-shaped spray which extends radially outwardly and upwardly away from the spray head. Ideally, the water fall-out distribution pattern produced by a spray head, like substantially any irrigation sprinkler, should be a straight line, 30 degree sloped wedge with the maximum precipitation at the spray head and zero at the maximum radius of water throw. With the ideal distribution pattern, the spacing between adjacent spray heads in a system should be equal to the maximum radial distance of throw so that the resultant precipitation rate over the area between sprinklers is uniform.

While the use of both metal and plastic spray heads have met with wide acceptance, one problem that has long plagued such spray heads is the inability of the spray head to disburse water in the immediate area around the spray head itself. That is, spray heads have typically produced distribution patterns which have maximum fall-out commencing approximately two feet radially away from the sprinkler, and thereafter reducing to zero at the maximum distance of throw. Thus, the fall-out distribution pattern of water from both metal and plastic spray heads has generally resulted in little or no appreciable water in the area extending from the spray head radially outwardly to about two feet away, thereby producing an arcuate "dead zone" extending outwardly approximately two feet.

To compensate for this problem, it is common practice in the industry to install the spray heads of a sprinkler system two feet closer together than should be required. While closer spacing does help alleviate the problem in the absence of wind, the closer spacing of spray heads results in an increase in the number of spray heads required for a given area, thereby increasing the cost of both material and labor, and total water consumption.

While attempts have been made to solve the problem of a lack of close-in water from spray head type sprinklers, none has proved commercially successful. One attempt to resolve this problem in part-circle metal spray heads has been the addition of a machined arcuate slit in the body of the spray head below the nozzle outlet and which permits a small portion of the supply water to be disbursed as a low volume, high pressure fan-shaped spray below the main spray. Although the addition of such a machined slit has improved the water distribution pattern between three and six feet radially outwardly of the spray head, has been found to have little effect on the area between zero and two feet, that area still receiving essentially no water fall-out. One reason that the use of an additional machined slit is believed to have been unsuccessful in solving this problem is that the slit must be so small in size that it becomes readily and quickly clogged by particles in the water, thereby becoming inoperative.

Thus, there exists a need for a spray head type sprinkler having the ability to disburse water to the immediate arcuate area between zero and two feet radially outwardly of the spray head so as to more closely approximate the ideal distribution pattern, yet which is simple in design, low in cost of manufacture and assembly, and reliable in use to achieve matched precipitation rates. As will become apparent hereinafter, the present invention satisfies this need in a novel and nonobvious manner.

SUMMARY OF THE INVENTION

The present invention provides a spray head designed and constructed in such a manner that a substantial increase in the fall-out of water occurs in the area extending from the spray head outwardly to about two feet away from the spray head so that the over all distribution pattern closely approximates the ideal wedge-shaped pattern, thereby to insure that no "dead-zone" is present in the immediate area of the sprinkler. Moreover, the spray head of the present invention is relatively simple in design, low in cost of manufacture and assembly, and highly reliable and effective in use to produce a matched precipitation rate spray head having superior distribution characteristics over other similar prior art spray heads.

Toward the foregoing ends, the spray head of the invention includes a high pressure, high velocity primary spray outlet, similar to the spray outlet of prior art molded plastic spray heads, and a secondary spray outlet, specifically designed and constructed to produce a relatively low pressure, low velocity water spray effective for distributing water close-in to the spray head over the area from zero to approximately two feet away. With this construction, the combined distribution pattern of water fall-out produces a wedge-shaped pattern very close to the ideal precipitation pattern.

More specifically, the spray head is formed from three interrelated molded plastic components comprising a base, a base ring and a deflector cap vertically stacked and secured together to form the spray head body, with the deflector cap on top, the base on the bottom, and the base ring disposed therebetween. A primary flow passageway is formed to extend vertically through the spray head body to supply high pressure, high velocity water to the deflector cap which includes a deflector recess adapted to deflect water laterally outwardly as a fan-shaped spray, and the secondary water spray outlet is formed below the deflector surface. A tortious pathway is formed between the primary passageway and the secondary outlet and which functions to bleed a portion of the water from the primary passageway and to induce turbulence into the bleed water flow to substantially reduce its pressure and velocity. The low pressure, low velocity bleed water is then disbursed through the secondary outlet as a spray which falls out close in to the spray head.

Since the spray head is formed from three separately molded components, each of which can be configured to cooperatively form a spray head for irrigating substantially any sector of an arc, the components can be formed using straight-pull cores, thereby substantially simplifying and reducing the cost of manufacture. Moreover, since the principle of inducing turbulence into the flow for pressure and velocity reduction is employed in the flow to the secondary outlet, the size of the pathway from the primary passageway to the secondary outlet can be relatively large in cross-sectional size, thereby substantially eliminating the possibility of blockage due to particulate matter entrained in the supply water.

These and other advantages of the present invention will become more apparent from the following detailed description, taken in conjunction with the accompany drawings which illustrate, by way of example, the principles of the invention.

BRIEF DESCRIPTION OF THE DRAWINGS

FIG. 1 is a perspective view of a molded quarter circle plastic spray head shown mounted to the top of a stationary water supply riser, and embodying the principles of the present invention;

FIG. 2 is an enlarged exploded perspective view of the deflector cap, base ring, base and throttling screw component parts of the spray head of FIG. 1 before assembly;

FIG. 5 is an enlarged top plan view of the base ring component part of the spray head assembly of FIG. 2;

FIG. 6 is a cross-sectional view taken substantially along the line 6—6 of FIG. 5;

FIG. 7 is an enlarged cross-sectional view taken substantially along the line 7—7 of FIG. 1;

DETAILED DESCRIPTION OF THE PREFERRED EMBODIMENT

Figure 3:
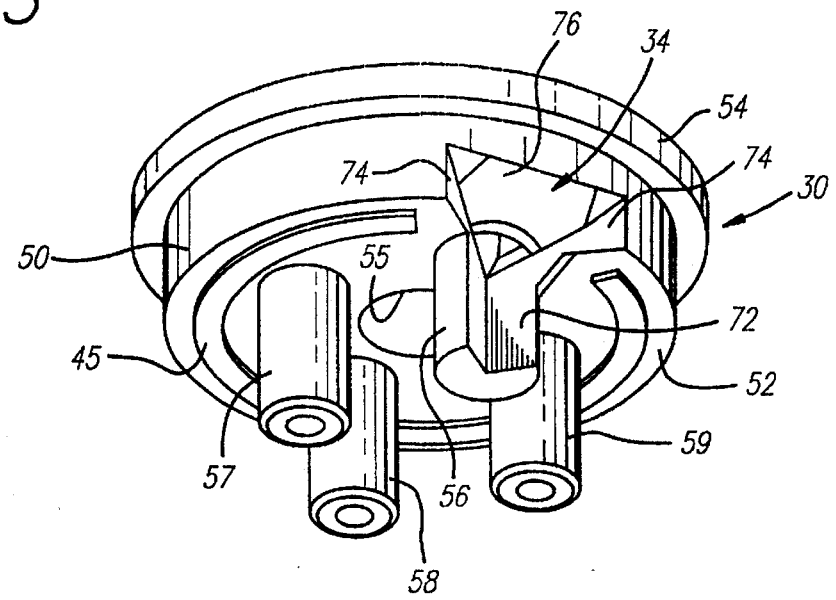
FIG. 3 is an enlarged perspective view of the deflector cap component part of the spray head assembly of FIG. 2.

As shown in the exemplary drawings the present invention is embodied in a new and improved spray head type sprinkler, generally designated 10, which is adapted to be coupled to the upper end of a tubular water supply pipe or riser 12, typically either a stationary riser as shown, or a riser forming a pop-up stem of a pop-up sprinkler unit (not shown). In this instance, the spray head 10 is formed of molded plastic, such as an ABS plastic, and includes an adjustable throttling screw 14, herein metal, having an enlarged head 15 at its lower end which cooperates with a tapered upper end wall 16 of a conventional rock screen 18 secured between the spray head and the upper end of the riser 12. Typically, the riser 12 is coupled to a suitable pressurized water source (not shown), and the throttling screw 14 is adjusted, such as by turning the screw with a screw driver blade inserted into a slot 20 formed in the upper end of the screw, to move the head 15 toward or away from the tapered wall 16 of the rock screen 18 to control the flow of water from the riser into the spray head for adjusting the distance of water throw from the sprinkler.

In accordance with the present invention, the spray head 10 is designed and constructed in such a manner that a substantial increase in the fall-out of water occurs in the area extending from the spray head outwardly to about two feet away from the spray head so that the over all distribution pattern closely approximates the ideal wedge-shaped pattern, thereby to insure that no "dead-zone" is present in the immediate area of the sprinkler. Moreover, the spray head 10 of the present invention is relatively simple in design, low in cost of manufacture and assembly, and highly reliable and effective to use to produce a matched precipitation rate spray head having superior distribution characteristics over other similar prior art spray heads.

Toward the foregoing needs, the spray head 10 is designed to include a primary relatively high pressure, high velocity spray producing outlet, generally designated 22, which is similar in size and shape to the spray outlet of other prior art molded plastic spray heads, and a secondary spray outlet, generally designated 24, which is specifically design and constructed to produce a relatively low pressure, low velocity water spray effective for distributing water close-in to the spray head over the area from zero to approximately two feet away. The combined distribution pattern of water fall-out from the primary outlet 22 and secondary outlet 24 produces a wedge-shaped pattern very close to the ideal precipitation pattern.

With primary reference to the embodiment shown in FIGS. 1 through 8 which depicts a molded plastic quarter-circle matched precipitation rate spray head 10, the spray head herein is formed as a generally cylindrical shaped body from three interrelated but separate molded plastic components comprising a base 26, a base ring 28 and a deflector cap 30. As depicted in FIG. 2, the spray head 10 is assembled by stacking the three plastic components 26, 28 and 30 vertically together with the deflector cap 30 on top, the base 26 on the bottom, and the base ring 28 disposed therebetween. Once the three plastic components 26, 28 and 30 have been assembled, they are bonded together such as by welding to produce an integral unit. The throttling screw 14 which is then assembled to the spray head after assembly of the molded plastic components. In the assembled condition, the primary spray outlet 22 is formed as a quarter-circle arcuate opening defined between the upper end 32 of the base ring 38 and a quarter-circle deflector recess 34 formed in a peripheral portion in the underside of the deflector cap 30, and the secondary outlet 24 is defined by a quarter-circle arcuate opening formed between the lower end 36 of the base ring and an upwardly and radially outwardly open recess 38 in the upper end portion of the base 26.

Figure 4:
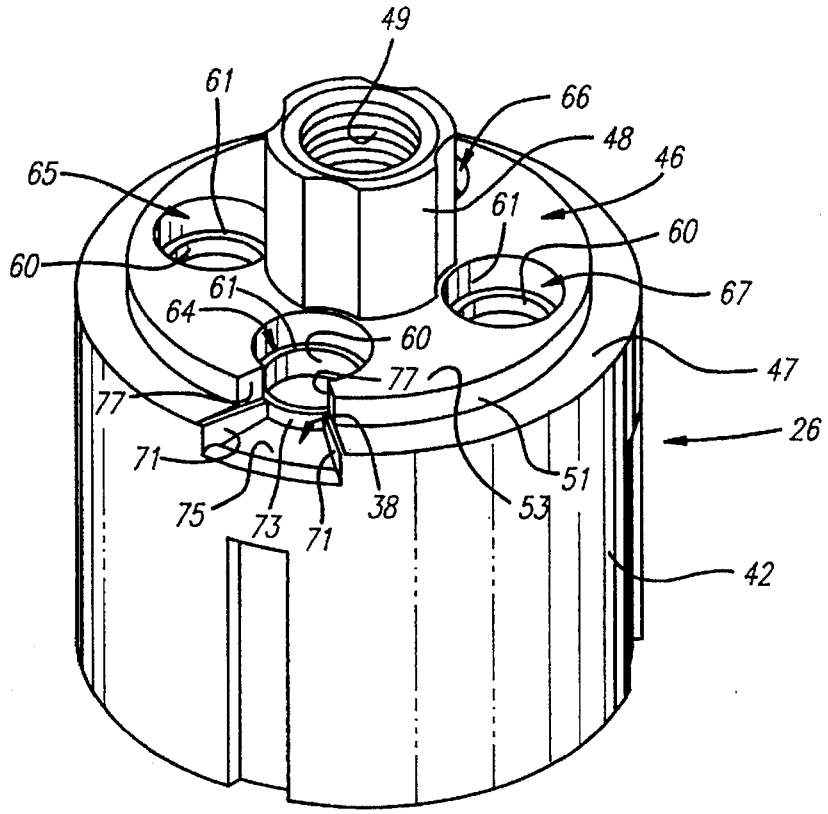
FIG. 4 is an enlarged perspective view of the base component part of the spray head assembly of FIG. 2.

As best seen in FIGS. 2 and 4, the base 26 is formed as an inverted cup-shaped cylindrical member having internal threads 40 formed around the lower skirt portion 42 which are adapted to mate with corresponding external threads 44 formed around the upper end portion of the riser 12, and an upper stepped end wall, generally designated 46, having an upwardly projecting central hollow cylindrical post 48. The internal surface of the post 48 is formed with threads 49 which are adapted to mate with external threads 19 formed about the shank of the throttling screw 14.

The upper stepped wall 46 of the base 26 defines an outer upwardly facing horizontal shoulder 47 interconnected through a relatively short vertical sidewall 51 with a generally horizontal top portion 53 extending to the post 48. Disposed at equally spaced arcuate locations through the top portion 53 are four cylindrical holes 64, 65, 66 and 67, each herein having a lower wall portion 60 of reduced diameter defining an upwardly facing annular wall 61.

The deflector cap 30 overlies the upper end of the base 26, and herein is formed to be generally cup-shaped with a vertical cylindrical wall portion 50 having an outer surface diameter substantially the same as that of the outer surface of the skirt portion 42 of the base, a generally horizontal bottom wall portion 52, and a radially enlarged peripheral flange portion 54 projecting outwardly around the upper end of the wall portion. A central opening 55 is formed through the bottom 52 of the deflector cap 30, and which is dimensioned to permit the upper end portion of the throttling screw 14 to project therethrough for adjustment thereof.

Disposed to project downwardly from the underside of the bottom wall 52 of the deflector cap 30 are four equally spaced elongated cylindrical pins 56, 57, 58 and 59, which are dimensioned and positioned to frictionally mate within the holes 64, 65, 66 and 67, through the end wall 46 of the base 26. The pins 56–59 and holes 64–67 serve to locate and mount the deflector cap 30 to the base 26, and also function to provide a controlled opening through the base for the flow of water to the primary outlet 22 and secondary outlet 24.

In this latter respect, it will be noted that in the quarter-circle embodiment of FIGS. 1–8, a quarter-circle pie-shaped longitudinal groove 72 is formed in pin 56 and which leads to the deflector recess 34 formed in the deflector cap 30, the deflector recess being herein formed by generally vertically diverging sides 74 and a generally flat deflector top 76 which is upwardly and radially outwardly inclined. It should be noted that the precise shape of the deflector recess 34 can take various forms appropriate for the precipitation rate, distribution and pattern desired, and forms no part of the present invention.

When the deflector cap 30 is assembled to the base 26 with each of the pins 56–59 projecting into one of the holes 64–67, a quarter-circle cross-sectional vertical passageway (see FIGS. 7 and 8) is formed between the walls of the groove 72 and the wall of the associated hole 64 so that water can pass virtually therebetween through the end wall 46 of the base. As will be readily understood by those familiar with matched precipitation rate plastic spray heads, by appropriately forming the size and shape of the groove 72 in one or more of the pins 56–59, and the size of one or more of the holes 64–67, the volume of water permitted to flow through the spray head 10 can be controlled so that, for example, a quarter-circle spray head will disburse one half the volume of water as that distributed by a half-circle spray head (such as shown in the embodiment of FIG. 9), thereby to achieve matched precipitation rates between various spray heads.

Figure 8:
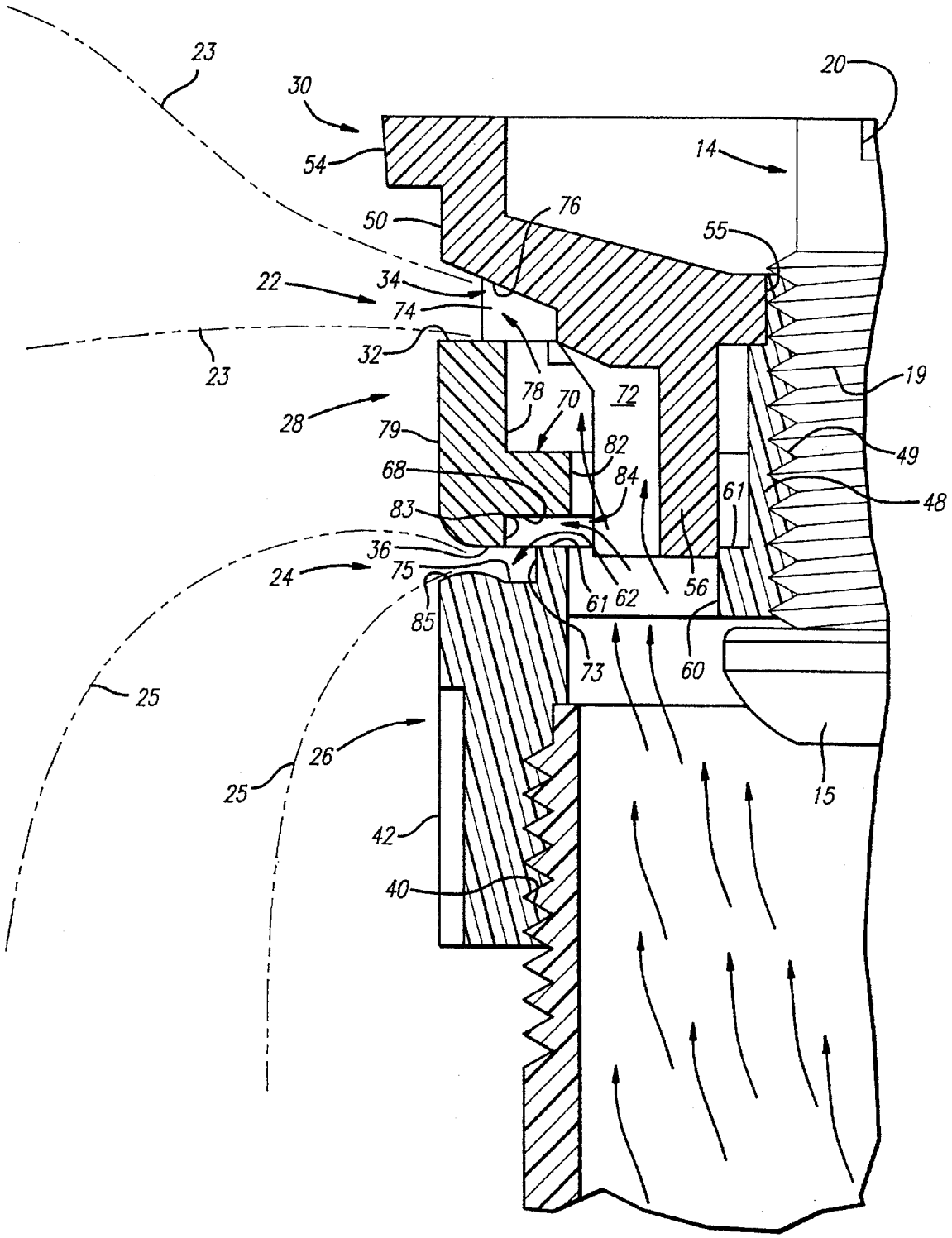
FIG. 8 is an enlarged cross-sectional view like that of FIG. 7, but modified to show the path of water flow through the spray head.
Figure 9:
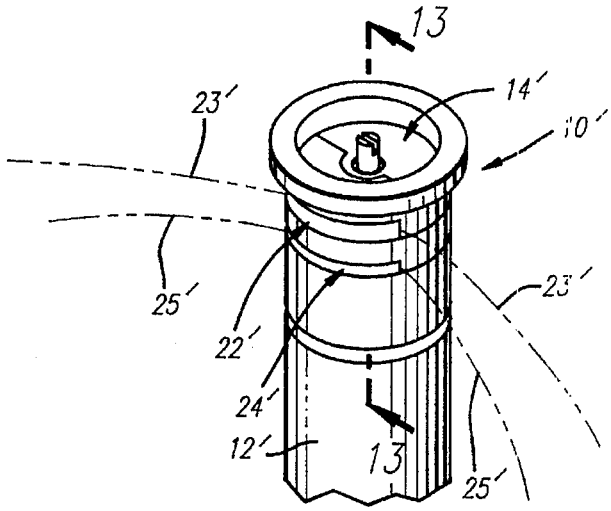
FIG. 9 is a perspective view similar to FIG. 1 but showing the spray head of the invention modified to produce a half-circle spray pattern.

As depicted in FIGS. 1 and 8, a major portion of the pressurized water passing from the riser 12 through the passageway formed by the groove 72 and associated hole 64 will flow vertically upwardly and impinge on the top 76 of the deflector recess 34 and then be deflected radially outwardly and upwardly. Due to the vertical diverging sides 74 of the deflector recess 34, the water will be projected outwardly from the primary opening 22 as a relatively high pressure quarter-circle fan-shaped spray, herein generally depicted by broken lines 23, having considerable velocity which projects the spray outwardly to the maximum radius of throw. Since the primary spray 23 is a relatively high pressure and velocity spray, very little water will fall-out from the spray over the first approximately two feet, thereby producing a relatively dry, "dead zone" extending from the spray head 10 outwardly to about two feet away.

To enhance close-in watering and eliminate the dead zone from the primary spray 23, a relatively small portion of the water passing vertically through the hole 64 and lower portion of the groove 72 is siphoned laterally through a tortious pathway 62 to the secondary opening 24. As best seen in FIGS. 4, 5, 6 and 8, the tortious pathway 62 is defined by the lower surface 68 of a radially inwardly projecting tab 70 formed on the base ring 28 and the surfaces of the upwardly and radially outwardly open recess 38 which is formed as a quarter-circle generally pie-shaped recess in the stepped end wall 46 of the base 26 extending laterally from the hole 64.

The upwardly and radially outwardly open recess 38 herein is defined by a lower pair of opposed laterally diverging sidewalls 71 extending radially outwardly from an arcuate vertical sidewall 73 forming the lower wall portion 60 of the hole 64, to the outer surface of the base 26 below the shoulder 61, and defining therebetween a generally flat horizontal bottom wall 75. The radially inner end of the recess 38 is open to the hole 64 above the annular wall 61 of the arcuate sidewall 73, and an upper pair of opposed laterally diverging sidewalls 77 extend radially outwardly from the hole through the short vertical sidewall 51 above the end walls 71.

As can best be seen in FIGS. 5 through 8, the base ring 28 is interposed between the base 26 and deflector cap 30, and has an inner vertical sidewall 78 dimensioned to frictionally engage the short vertical sidewall 51 of the base 26, and an outer sidewall 79 dimensioned to have a diameter substantially the same as the outer diameter of the base and the cylindrical wall portion 50 of the deflector cap. The lower end 36 of the base ring 28 seats on the upwardly facing shoulder 47 of the base 26, and the bottom 52 of the deflector cap 30 seats on the upper end 32 of the base ring, a downwardly extending arcuate rib 45 being herein formed on the bottom of the deflector cap to fit snugly within the inner vertical wall 78 for ease of assembly.

The tab 70 is disposed to project radially inwardly from the inner sidewall 78 of the base ring 28, and is formed as a flat plate with a horizontal bottom forming the lower surface 68, and inwardly converging vertical sides 80 and 81 interconnected by an arcuate inner vertical end wall 82. The inner end wall 82 of the tab 70 is formed to have a radius of curvature substantially equal to that of the upper portion of the hole 64 so that when the base ring 28 is assembled with the base 26, the inner end wall 82 forms a portion of the cylindrical boundary defining an upper part of the hole 64.

Importantly, the tab 70 is formed to project inwardly above the lower end 36 of the base ring 28 so that a short vertical surface 83 is formed between the lower end of the base ring and the bottom 68 of the tab. The vertical sides 80 and 81 are dimensioned to frictionally engage the opposed laterally diverging sidewalls 77 of recess 38 in the base 26, so that when the base and base ring 28 are assembled, the tab 70 effectively forms a closed top for the upper portion of the recess in the base, an arcuate slit-like lateral opening 84 being thereby defined between the annular wall 61 of the hole 64 in the base and the bottom 68 of the tab 70, and which opens laterally from the hole to the vertical surface 83 of the base ring 28 below the tab.

Since the tab 70 extends from the hole 64 to the inner wall 78 of the base ring 28, and the arcuate sidewall 73 of the base 26 is formed radially inwardly of the short vertical surface 83, a downwardly open arcuate passage is defined between the arcuate sidewall 73 and the outer surface of the short vertical surface 83, and which is disposed over the bottom 75 of the recess 38. With this configuration, a small portion of the pressurized water passing through the hole 64 will be siphoned laterally through the slit-like opening 84, impinge on the short vertical surface 83 of the base ring 28 below the tab 70, and then be turned ninety degrees to move downwardly through the arcuate passage and impinge on the bottom 75 of the recess 38. Thereafter, the water is again turned ninety degrees to flow laterally outwardly through the secondary opening 24 as a fan-shaped spray, herein generally depicted by broken lines 25.

It should be noted that by causing the pressurized water siphoned from the main flow through the hole 64 to successively impinge on the short vertical surface 83 and be deflected ninety degrees and thereafter impinge on the horizontal bottom 75 and again be deflected ninety degrees, substantial turbulence is created in the flow. The substantial turbulence created by these deflections acts to decelerate the flow and dissipate both the pressure and velocity energy of the siphoned-off water. Therefore, upon reaching the secondary opening 24, the water siphoned from the hole 64 will be projected outwardly with very little velocity and pressure, causing the flow to exit the secondary opening as a spray 25 which falls rapidly to the ground in the area immediately adjacent the sprinkler. To further induce turbulence and disrupt flow to promote rapid fall-out, herein a raised convex lip 85 is formed along the radially outer edge of the bottom 75 of the recess 38.

With the present invention, it has been found that by incorporating the secondary outlet 24 into the design of a conventional molded plastic quarter-circle spray head such as that marketed by Rain Bird Sprinkler Mfg. Corp. of Glendora, Calif. under its designation 1800 Series Plastic MPR Nozzle, the amount of water applied to the ground in the arcuate area extending outwardly from the spray head to approximately two feet is up to five times greater than with a conventional spray head. Moreover, the addition of the secondary outlet 24 does not result in any appreciable reduction in the maximum range achieved of the primary spray 23, but merely redistributes the water over the quarter-circle area so that the resultant distribution pattern very closely approximates the ideal.

In addition to applicability of the present invention to quarter-circle spray heads 10, the addition of a secondary outlet 24 can be provided for enhancing the close-in water of other plastic spray head shapes. Shown in FIGS. 9 through 15 is a half-circle matched precipitation rate molded plastic spray head 10 into which the principles of the present invention have been incorporated, parts shown in the drawings of FIGS. 9–15 which are similar in function or structure to the parts described above in connection with FIGS. 1–8 being designated by corresponding primed reference numerals.

Figure 10:
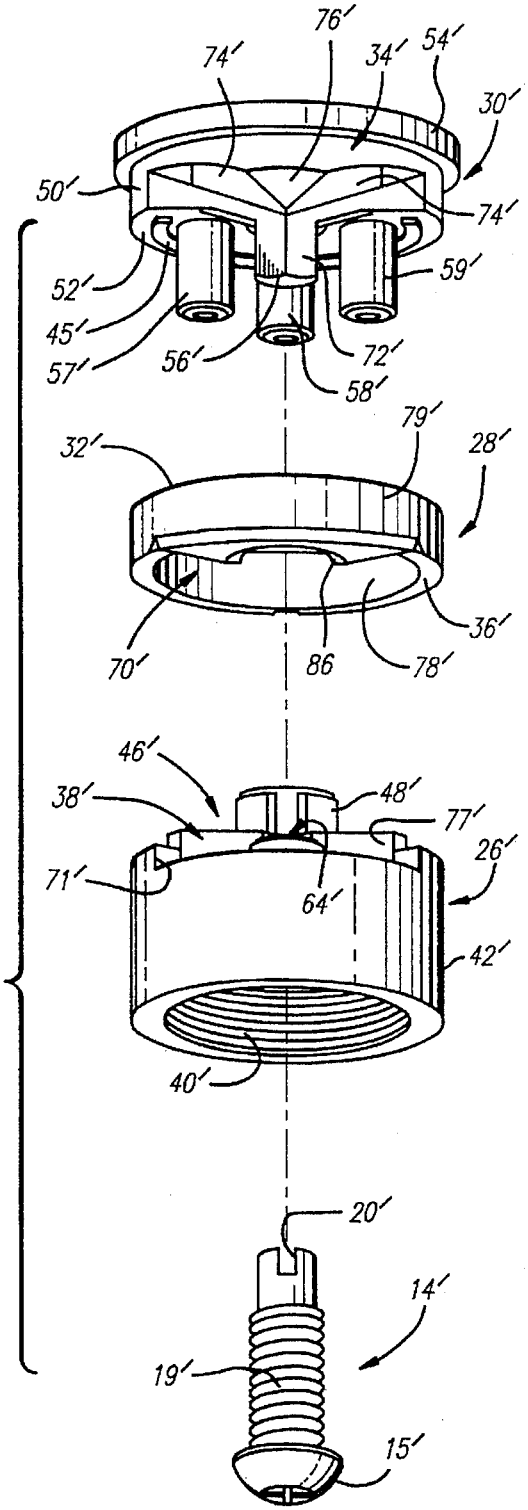
FIG. 10 is an enlarged exploded perspective view of the deflector cap, base ring, base and throttling screw component parts of the spray head sprinkler of FIG. 9.
Figure 11:
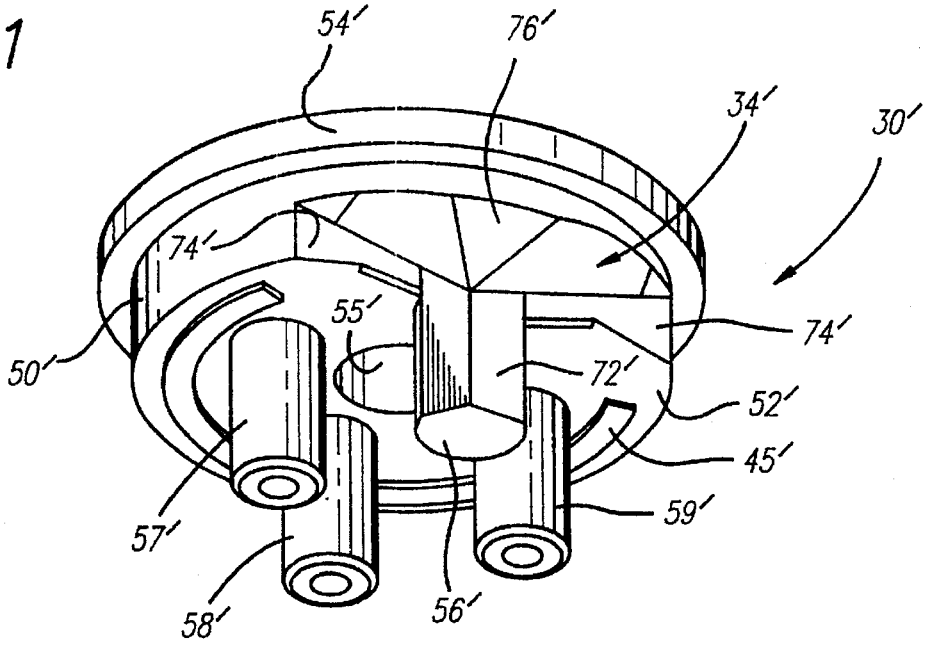
FIG. 11 is an enlarged perspective view of the base component part of the spray head assembly of FIG. 9.
Figure 12:
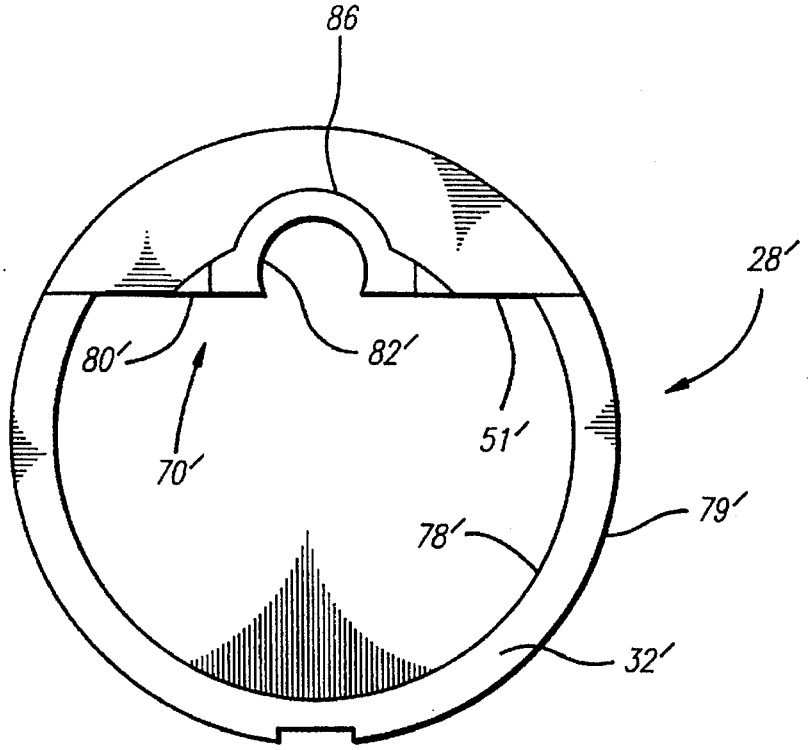
FIG. 12 is an enlarged plan view of the deflector ring component part of the spray head assembly of FIG. 9.
Figure 13:
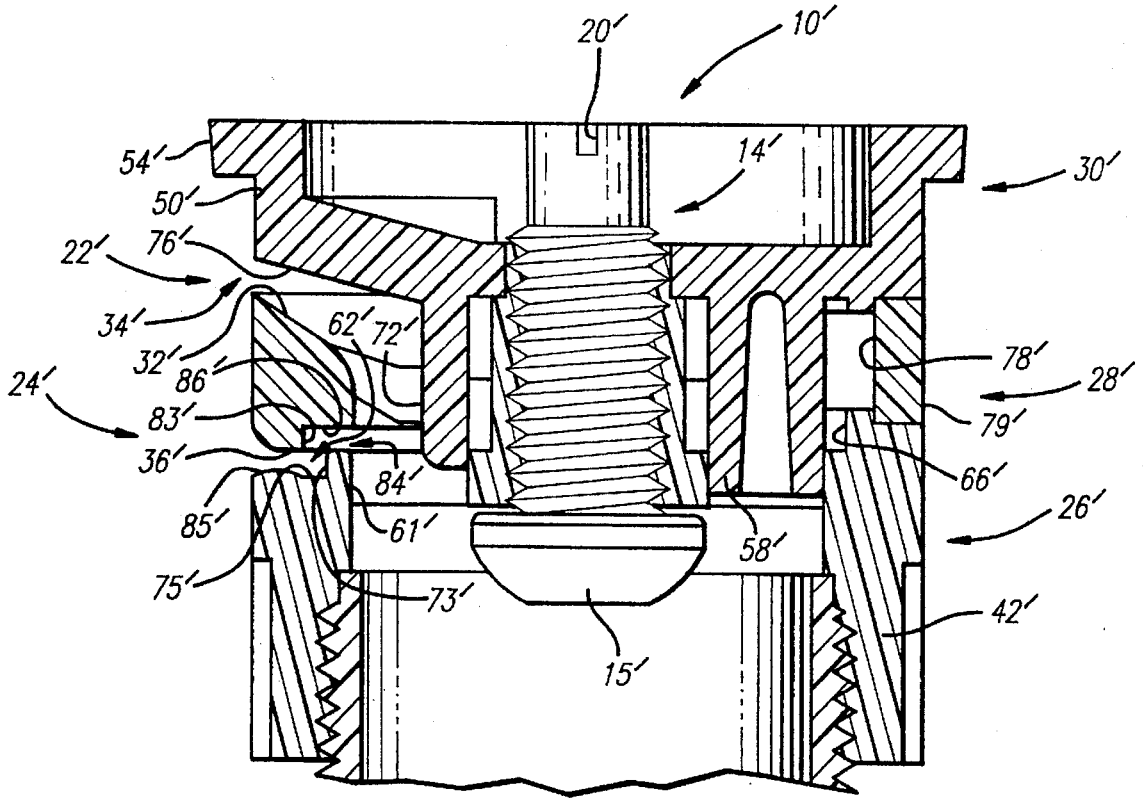
FIG. 13 is an enlarged cross-sectional view taken substantially along the line 13—13 of FIG. 9.

In this instance, as seen best in FIGS. 10 and 11, the deflector cap 30' has diverging sides 74' and a top 76' which define a semi-circular deflector recess 34', and the pin 64' is formed with a groove 72' which together with the associated hole 64' permits a volume of water flow to pass therethrough which is twice the flow permitted by the groove 72 and hole 64 of the embodiment of FIGS. 1–8. The resultant spray 23' produced by the deflector cap 30' will be a high pressure, high velocity fan-shaped spray extending outwardly over an area one hundred-eighty degrees relative to the spray head 10'.

To form the secondary outlet 24', the upwardly and radially outwardly open recess 38' in the base 26' herein is formed as a sector shaped recess extending outwardly from adjacent the hole 64' into which the pin 56' projects with the laterally diverging sidewalls 71' and 77' each extending in opposite directions away from each other to the outer surface of the base. The inner end of the recess 38' is open to the hole 64' above the annular wall 61' of the arcuate sidewall 73' defining the lower portion 60' of the hole 64'. Like the embodiment of FIGS. 1–8, a raised convex lip 85' is formed along the radially outer edge of the bottom 75' of the recess 38' between the sidewalls 71'.

The tab 70' formed in the base ring 28' overlying the recess 38' of the base 26' herein is formed as a generally horizontal plate with the vertical sides 80' and 81' extending from the inner sidewall 78' to overlie the diverging sidewalls 71' and 77' of the recess, and which terminate inwardly in an arcuate end wall 82' dimensioned to effectively form a continuation of the radially outer upper wall portion of the hole 64'. Notably, an arcuate groove 86 is formed in the lower surface 68' of the tab 70' around and concentric with the end wall 82', and which defines the short vertical surface 83' against which water laterally siphoned-off from the hole 64' through the slit-like opening 84' impinges and is deflected downwardly. Thus, like the embodiment of FIGS. 1–8, water flowing laterally through the slit-like opening 84' will be deflected ninety degrees downwardly by the vertical surface 83' and then impinge on the bottom 75' of the groove 38' and be deflected another ninety degrees, over the lip 85' and out through the secondary outlet 24'. These successive deflections dissipate the flow energy, causing the flow to be disbursed as a low pressure, low velocity spray 25' which rapidly falls to the ground over a semi-circular area extending from the spray head 10' outwardly approximately two feet.

An important advantage achieved by the present invention is that each of the molded plastic base 26, base ring 28, and deflector cap 30 components can be inexpensively and relatively easily molded without requiring complex molds or dies. That is, each of the components can be readily molded using straight-pull techniques without requiring complex mold slides or multiple molding steps. Further, the spray head can be quickly and easily assembled, and requires only a single welding or bonding step to bond the pins 56–59 to the holes 64–67 and/or the bottom 52 of the deflector cap 30 to the top 32 of the base ring 28 and the bottom 36 of the base ring to the top 46 of the base 26.

Moreover, since the principle of energy dissipation by inducing turbulence into the flow through successive flow deflections is employed, the size of the slit-like opening 84, as well as the other openings and passages leading to and defining the secondary outlet 24 can be of relatively large size. The ability to employ relatively large openings and passages substantially eliminates any possibility of clogging or blockage by water-born particulate matter, thereby substantially enhancing the effectiveness and reliability of the spray head 10.

From the foregoing, it should be apparent that the present invention provides a molded plastic spray head which is relatively simple in design, low in cost of manufacture and reliable in use, and which can be readily adapted to form a spray head for irrigating substantially any size arcuate segment about the sprinkler. Moreover, the spray head of the present invention is highly effective in use and substantially eliminates the "dead zone", thereby permitting the sprinklers to be spaced further apart without any sacrifice in water application uniformity. While a particular form of the invention has been illustrated and described, it should also be apparent that various modifications and changes can be made without departing from the spirit and scope of the invention.

What is claimed is:

1. In a plastic part circle irrigation sprinkler of the spray head type having a generally cylindrical body formed of molded plastic and defining a lower end portion and an upper end portion interconnected by a central portion having an outer cylindrical surface, the lower end portion adapted to be coupled to a source of pressurized water and the upper end portion defining a deflector cap having a generally pie-shaped laterally outwardly diverging deflector recess formed in a peripheral portion thereof and adapted to deflect water laterally outwardly away from the body as a generally high pressure, high velocity fan-shaped spray, and a generally vertically directed water passageway extending through the body for providing a water flow path between the pressurized water source and the deflector recess, the improvement comprising:

a secondary water spray outlet formed in said outer surface of said body below said deflector surface, said secondary water spray outlet being vertically aligned with said deflector recess and coupled with said water passageway through said body by a generally laterally directed tortious pathway formed to divert a portion of the pressurized water flowing through said water passageway to said secondary spray outlet and to disperse said diverted water portion laterally outwardly away from the body as a generally low pressure, low velocity water spray having substantially the same fan-shaped pattern as that produced by said deflector surface, said tortious pathway including a series of at least two successive sharp angled turns of approximately ninety degrees each formed in said pathway between said water passageway and said secondary spray outlet.

2. The improvement as set forth in claim 1 wherein said cylindrical body is formed from three separately molded plastic components secured together to form an integral unit.

3. The improvement as set forth in claim 2 wherein said three plastic components comprise:

a generally cylindrical base member having upper and lower ends, and including threads for coupling said lower end to said source of pressurized water;

a generally cylindrical ring-shaped member having inner and outer sides and top and bottom ends, said bottom end being secured to said upper end of said base member to be concentric therewith; and a generally cylindrical deflector cap member secured in overlying, concentric relationship to said top end of said ring-shaped member.

4. The improvement as set forth in claim 3 wherein said tortious pathway is formed between said upper end of said base member and said bottom end of said ring-shaped member.

5. The improvement as set forth in claim 4 wherein said tortious pathway is defined by a first laterally directed portion extending radially outwardly from said water passageway, a second generally vertically directed portion extending downwardly from the radially outer end of said first portion, and a third portion extending radially outwardly from the outer end of said second portion and parallel with said first portion, said third portion terminating at said secondary outlet.

6. The improvement as set forth in claim 5 wherein said first, second, and third portions of said tortious pathway each have vertical sides formed to define a laterally diverging flow path between said water passageway and said secondary spray outlet.

7. The improvement as set forth in claim 6 wherein said ring shaped member includes a laterally projecting tab extending radially inwardly from said inner surface, and formed to define a laterally outer portion of said water passageway above said base member, said tab being spaced vertically above said upper end of said base member so as to define therewith an entrance to said tortious pathway from said water passageway.

8. A molded plastic spray head irrigation sprinkler adapted to be coupled to a pressurized water source for dispersing a water spray laterally outwardly in an arcuate shaped pattern, comprising:

a generally cylindrical body including a cylindrical base member having a lower end portion adapted to be coupled to a pressurized water supply source, and an upper deflector cap member having a deflector surface formed therein and adapted to disperse pressurized water laterally outwardly as a high pressure, high velocity fan shaped spray;

a generally vertical water flow passageway formed in said body and communicating between said lower end portion of said base member and said deflector surface of said deflector cap member;

a laterally open secondary water outlet formed in said body below and vertically aligned with said deflector surface and formed to disperse water with substantially the same spray pattern as that produced by said deflector surface; and a tortious water pathway within said body and extending between said water passageway and said secondary outlet, said pathway being formed to bleed a portion of the water flowing through said passageway laterally to said secondary outlet and to induce turbulence into said bleed water to reduce the pressure and velocity of the water flowing through said pathway, said tortious pathway including a series of at least two successive sharp angled turns of approximately ninety degrees each formed in said pathway between said water passageway and said secondary spray outlet, whereby water dispersed from said secondary outlet has a pressure and velocity substantially lower than that dispersed by said deflector surface.

9. A molded plastic spray head as set forth in claim 8 wherein said cylindrical body is formed from three separately molded plastic components secured together to form an integral unit.

10. A molded plastic spray head as set forth in claim 9 wherein said three plastic components comprise:

a generally cylindrical base member having upper and lower ends, and including threads for coupling said lower end to said source of pressurized water;

a generally cylindrical ring-shaped member having inner and outer sides and top and bottom ends, said bottom end being secured to said upper end of said base member to be concentric therewith; and a generally cylindrical deflector cap member secured in overlying, concentric relationship to said top end of said ring-shaped member.

11. A molded plastic spray head as set forth in claim 10 wherein said tortious pathway is formed between said upper end of said base member and said bottom end of said ring-shaped member.

12. A molded plastic spray head as set forth in claim 11 wherein said tortious pathway is defined by a first laterally directed portion extending radially outwardly from said water passageway, a second generally vertically directed portion extending downwardly from the radially outer end of said first portion, and a third portion extending radially outwardly from the outer end of said second portion and parallel with said first portion, said third portion terminating at said secondary outlet.

13. A molded plastic spray head as set forth in claim 12 wherein said first, second, and third portions of said tortious pathway each have vertical sides formed to define a laterally diverging flow path between said water passageway and said secondary spray outlet.

14. A molded plastic spray head as set forth in claim 13 wherein said ring shaped member includes a laterally projecting tab extending radially inwardly from said inner surface, and formed to define a laterally outer portion of said water passageway above said base member, said tab being spaced vertically above said upper end of said base member so as to define therewith an entrance to said tortious pathway from said water passageway.

15. In a part-circle plastic spray head type irrigation sprinkler having a body adapted to be coupled to a source of pressurized water and a primary spray outlet adapted to receive water from the source through a generally vertical water flow passageway and to disperse a high pressure, high velocity fan shaped spray laterally outwardly over an arcuate shaped area, the improvement comprising:

a laterally opening secondary spray outlet formed in said body below said primary spray outlet, and a tortious water flow pathway extending laterally between said vertical passageway and said secondary outlet, said tortious pathway being formed to induce turbulence into water flowing between said passageway and said secondary outlet and defined by a first laterally directed portion extending radially outwardly from said water passageway, a second generally vertically directed portion extending from the radially outer end of said first portion, and a third portion extending radially outwardly from the outer end of said second portion and parallel with said first portion, said third portion terminating at said secondary outlet, whereby water dispersed from said secondary spray outlet has a substantially lower pressure and velocity than that dispersed by said primary spray outlet.

16. The improvement as set forth in claim 15 wherein said tortious pathway includes a series of at least two successive sharp angled turns formed in said pathway between said first portion and said secondary spray outlet.

17. The improvement as set forth in claim 16 wherein sharp angled turns are each approximately ninety degrees.

18. The improvement as set forth in claim 15 wherein said body is formed from three separately molded plastic components secured together to form an integral unit.

19. The improvement as set forth in claim 18 wherein said three plastic components comprise:

a generally cylindrical base member having upper and lower ends, and including threads for coupling said lower end to said source of pressurized water;

a generally cylindrical ring-shaped member having inner and outer sides and top and bottom ends, said bottom end being secured to said upper end of said base member to be concentric therewith; and a generally cylindrical deflector cap member secured in overlying, concentric relationship to said top end of said ring-shaped member.

20. The improvement as set forth in claim 15 wherein said first, second, and third portions of said tortious pathway each have vertical sides formed to define a laterally diverging flow path between said water passageway and said secondary spray outlet.

21. The improvement as set forth in claim 19 wherein said ring shaped member includes a laterally projecting tab extending radially inwardly from said inner surface, and formed to define a laterally outer portion of said water passageway above said base member, said tab being spaced vertically above said upper end of said base member so as to define therewith an entrance to said tortious pathway from said water passageway.

22. The improvement as set forth in claim 21 wherein said tortious pathway includes a series of at least two successive sharp angled turns formed in said pathway between said water passageway and said secondary spray outlet.

23. The improvement as set forth in claim 22 wherein sharp angled turns are each approximately ninety degrees.

* * * * *